US007174881B2

(12) United States Patent
Tian et al.

(10) Patent No.: US 7,174,881 B2
(45) Date of Patent: Feb. 13, 2007

(54) ACTUATION VALVE FOR CONTROLLING FUEL INJECTOR AND COMPRESSION RELEASE VALVE, AND ENGINE USING SAME

(75) Inventors: Ye Tian, Bloomington, IL (US); Scott Leman, Eureka, IL (US); Xinshuang Nan, Bloomington, IL (US); Lifeng Wang, Normal, IL (US); Jianyuan Yang, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 589 days.

(21) Appl. No.: 10/017,523

(22) Filed: Dec. 7, 2001

(65) Prior Publication Data

US 2003/0106532 A1 Jun. 12, 2003

(51) Int. Cl.
*F02M 37/04* (2006.01)

(52) U.S. Cl. ..... 123/508; 123/90.12

(58) Field of Classification Search ..... 123/90.12, 123/90.13, 90.15, 508, 509, 446, 447, 497; 419/380

See application file for complete search history.

(56) References Cited

U.S. PATENT DOCUMENTS 5,237,968 A * 8/1993 Miller et al. ..... 123/90.11
5,237,976 A * 8/1993 Lawrence et al. ..... 123/508
5,609,134 A * 3/1997 Schmidt et al. ..... 123/322
5,735,242 A * 4/1998 Kahlenbeck et al. ..... 123/322
5,738,075 A * 4/1998 Chen et al. ..... 123/446
5,806,474 A * 9/1998 Paul et al. ..... 123/90.12
5,934,245 A 8/1999 Miller et al.
5,957,106 A 9/1999 Maloney et al.
6,173,685 B1 * 1/2001 Sturman ..... 123/90.12
6,311,668 B1 11/2001 Milam
6,321,701 B1 * 11/2001 Vorih et al. ..... 123/90.12
6,349,686 B1 * 2/2002 Feucht et al. ..... 123/90.12
6,364,282 B1 * 4/2002 Ausman et al. ..... 251/129.16
6,415,749 B1 * 7/2002 Sturman et al. ..... 123/70 R
6,769,405 B2 * 8/2004 Leman et al. ..... 123/446

* cited by examiner

*Primary Examiner*—Carl S. Miller
(74) *Attorney, Agent, or Firm*—Liell & McNeil

(57) ABSTRACT

The present invention relates to engines having multiple hydraulic devices. For instance a multi-cylinder diesel engine might include both an a fuel injector and an engine compression release brake. Traditionally, each of these hydraulic devices has been controlled by an individual actuator control valve. However, engineers have learned that decreasing the number of engine components can increase engine robustness. In addition, engineers have learned that de-coupling fluid pressure to the needle valve member hydraulic surface from fluid pressure lines to other injector components can result in greater control of the injector. Therefore, the present invention utilizes a single actuator control valve to control both hydraulic devices for an engine cylinder and to provide independent control of fluid pressure to the needle valve member closing hydraulic surface.

13 Claims, 4 Drawing Sheets

ACTUATION VALVE FOR CONTROLLING FUEL INJECTOR AND COMPRESSION RELEASE VALVE, AND ENGINE USING SAME

TECHNICAL FIELD

This invention relates generally to engines, and more particularly to actuators for controlling hydraulically actuated fuel injectors and engine compression release brake valves.

BACKGROUND

In several multi-cylinder diesel engines today, a number of hydraulically actuated devices are coupled to each engine cylinder. For example, it is becoming common place for each cylinder to include a hydraulically actuated fuel injector and an engine compression release brake. In most instances, each of these hydraulic devices is controlled by its own individual fluid control valve. For instance, hydraulically actuated fuel injectors such as that shown in U.S. Pat. No. 5,738,075 issued to Chen et al. on Apr. 14, 1998, include a solenoid driven fluid control valve that is attached to the injector body. Fluid pressure to both an intensifier piston hydraulic surface and a direct control needle valve hydraulic surface is controlled by this control valve. While fuel injectors, and other hydraulic devices, including individual fluid control valves have performed adequately, there remains room for improvement. For instance, it is known in the art that a reduction in the number of engine components can make the engine more robust. Further, engineers have found that by de-coupling the fluid pressure line to the direct control needle valve from the fluid pressure line to other injector components, can result in greater control over injection events.

The present invention is directed to overcoming one or more of the problems as set forth above.

SUMMARY OF THE INVENTION

In one aspect of the present invention, a hydraulic system includes a source of high pressure fluid and a low pressure reservoir. An actuator control valve having a valve body is also provided. The valve body defines a high pressure passage that is fluidly connected to the source of high pressure fluid, a low pressure passage that is fluidly connected to the low pressure reservoir, and a device control passage. The actuator control valve is movable between a first position in which the device control passage is open to the low pressure passage, and a second position in which the device control passage is open to the high pressure passage. The device control passage is fluidly connected to at least one of a first hydraulic device and a second hydraulic device.

In another aspect of the present invention, an engine includes an engine housing that defines a plurality of cylinders. An actuator control valve is provided for each of the cylinders and is attached to the engine housing. The actuator control valve has a valve body that defines a device control passage, a high pressure passage and a low pressure passage. An electronic control module is provided that is in control communication with the actuator control valve. A first hydraulic device and a second hydraulic device are provided for each of the plurality of cylinders. A source of high pressure fluid is fluidly connected to the high pressure passage. A low pressure reservoir is fluidly connected to the low pressure passage. The actuator control valve is movable between a first position in which the device control passage is open to the low pressure passage and a second position in which the device control passage is open to the high pressure passage.

In still another aspect, a method of operating a fuel injector and an engine compression release brake includes a step of connecting the engine compression release brake and fuel injector to an actuator control valve. The engine compression release brake is actuated at least in part by activating the actuator control valve and disabling the fuel injector. The fuel injector is actuated at least in part by activating the actuator control valve.

DETAILED DESCRIPTION

Figure 1:
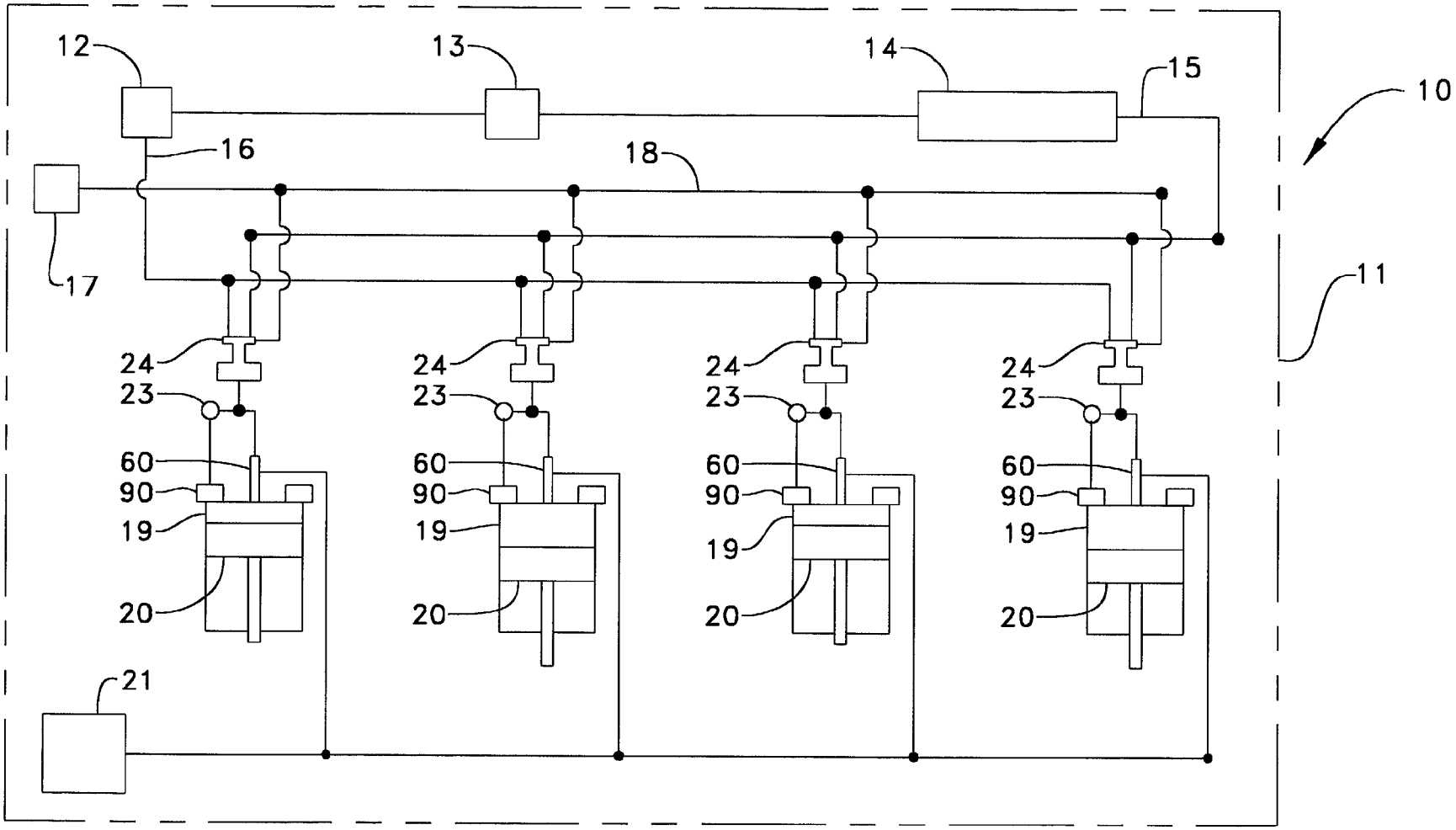
FIG. 1 is a schematic representation of an engine according to the present invention.

Referring to FIG. 1 there is shown an engine 10 according to the present invention. A low pressure reservoir 12 is provided in engine 10 and preferably includes an amount of low pressure engine lubricating oil. While low pressure reservoir 12 is preferably an oil pan that has an amount of engine lubricating oil, it should be appreciated that other fluid sources having an amount of available fluid, such as coolant, transmission fluid or fuel, could instead be used. A high pressure pump 13 pumps oil from low pressure reservoir 12 and delivers the same to high pressure manifold 14. High pressure oil flowing out of high pressure manifold 14 is delivered via high pressure fluid supply line 15 to a hydraulic system provided in engine 10, and oil is returned to low pressure reservoir 12 via low pressure return line 16 after it has performed work in the hydraulic system. Engine 10 also has an engine housing 11 that defines a plurality of cylinders 19.

Each of the cylinders 19 defined by engine housing 11 has a movable piston 20. Each piston 20 is movable between a retracted, downward position and an advanced, upward position. For a typical four cycle diesel engine 10, the advancing and retracting strokes of piston 20 correspond to the four stages of engine 10 operation. When piston 20 retracts from its top dead center position to its bottom dead center position for the first time, it is undergoing its intake stroke and air can be drawn into cylinder 19 via an intake valve. When piston 20 advances from its bottom dead center position to its top dead center position for the first time it is undergoing its compression stroke and air within cylinder 19 is compressed. At around the end of the compression stroke, fuel can be injected into cylinder 19 by fuel injector 60, and combustion within cylinder 19 can occur instantly, due to the high temperature of the compressed air. This combustion drives piston 20 downward toward its bottom dead center position, for the power stroke of piston 20. Finally, when piston 20 once again advances from its bottom dead center position to its top dead center position, post combustion products remaining in cylinder 19 can be vented via an exhaust valve corresponding to the exhaust stroke of piston 20, or partially vented via an engine compression release brake valve 90 during engine braking. While engine 10 has been illustrated as a four cycle, four-cylinder engine, it should be appreciated that any desired number of cylinders could be defined by engine housing 11.

Each cylinder 19 is operably connected to a number of hydraulically actuated devices. As illustrated in FIG. 1, these hydraulic devices are preferably a hydraulically actuated fuel injector 60 and an engine compression release brake 90. Fuel injector 60 is fluidly connected to a fuel tank 21 and delivers fuel to cylinder 19 for combustion while engine brake 90 controls release of compressed air from cylinder 19 when combustion is not desirable. A brake/injector actuator control valve 24 is fluidly connected to the fuel injector 60 and engine brake 90 of each cylinder 19. Brake/injector actuator control valve 24 preferably acts as a flow control valve, but could be modified to function as a pressure switch for fuel injector 60 and engine brake 90. Brake/injector actuator control valve 24 is controlled in operation by an electronic control module 17 via communication line 18.

A two-way valve 23 is preferably positioned between the brake/injector actuator control valve 24 and the engine brake 90 of each cylinder 19. Each of the two-way valves 23 can include its own individual electronic actuator, an individual mechanical actuator, or a single actuator that simultaneously opens and closes all of the two-way valves 23 based upon an electronic control signal and/or an operator control action. Those skilled in the art should appreciate that valve 23 could be eliminated and brake/injector actuator control valve 24 could be modified from that which is illustrated herein to perform the function of valve 23. Additionally, it should be appreciated that valve 23 could instead be a three-way valve. A more detailed description of this modified brake/injector actuator control valve 24 will follow the description of the actuator control valve 24 illustrated herein.

Figure 2:
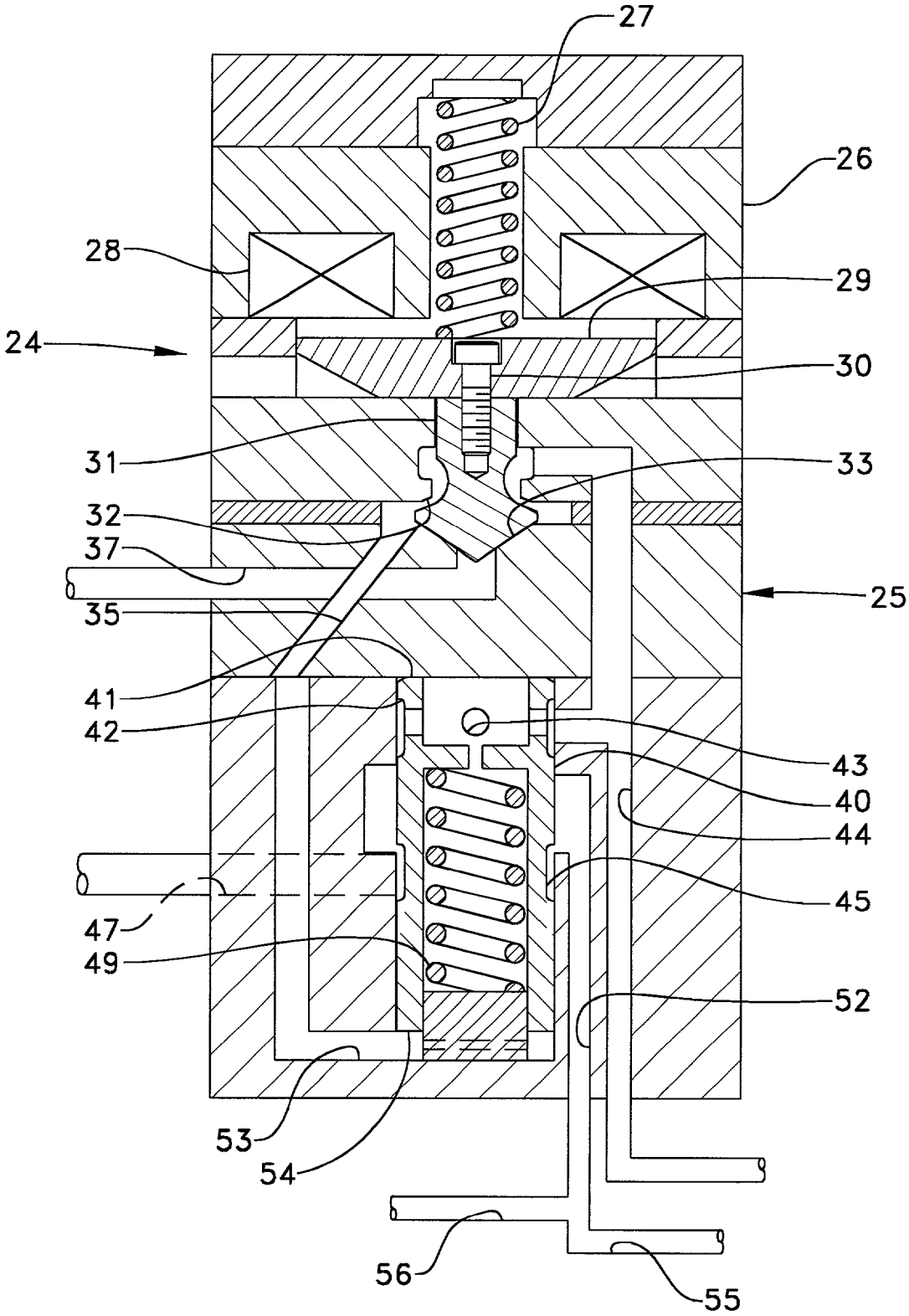
FIG. 2 is a sectioned side diagrammatic representation of an actuator according to the present invention.

Referring to FIG. 2, there is shown a sectioned side view of the brake/injector actuator control valve 24 of FIG. 1 according to the present invention. Brake/injector actuator control valve 24 has an valve body 25 that is attached to an electrical actuator 26. Electrical actuator 26 is preferably a solenoid that includes a coil 28 and an armature 29. Alternatively, electrical actuator 26 could be another device, such as a piezoelectric actuator. A fastener 30 attaches armature 29 to a pilot valve member 31, which is positioned in valve body 25 and trapped between a high pressure seat 32 and a low pressure seat 33. Valve body 25 defines a high pressure passage 44 that is fluidly connected to high pressure manifold 14 and a low pressure passage 37 that is fluidly connected to low pressure reservoir 12. When electrical actuator 26 is de-energized, such as when brake/injector actuator control valve 24 is in a first position, a biasing spring 27 biases pilot valve member 31 toward its downward position, closing low pressure seat 33. When pilot valve member 31 is in this position, a variable pressure passage 35 defined by valve body 25 is fluidly connected to high pressure passage 44. When electrical actuator 26 is energized, such as when brake/injector actuator control valve 24 is in a second position, armature 29 and pilot valve member 31 move upward toward its first position closing high pressure seat 32 and opening low pressure seat 33. When pilot valve member 31 is in this position, variable pressure passage 35 is fluidly connected to low pressure passage 37.

Returning to brake/injector actuator control valve 24, a spool valve member 40 is also positioned in valve body 25 and is movable between an upward, retracted position as shown, and a downward, advanced position. Spool valve member 40 is biased toward its retracted position by a biasing spring 49. Spool valve member 40 defines a high pressure annulus 42 that is always open to high pressure passage 44 and is positioned such that it can open a device control passage 52 to high pressure passage 44 when spool valve member 45 is in its advanced position. A low pressure annulus 45 is also provided on spool valve member 40 that can connect device control passage 52 to a low pressure passage 47 defined by valve body 25 when spool valve member 40 is in its retracted position as shown. Spool valve member 40 has a control hydraulic surface 54 that is exposed to fluid pressure in a spool cavity 53, and a high pressure surface 41 that is continuously exposed to high pressure in high pressure passage 44 via a number of radial passages 43 defined by spool valve member 40. Surfaces 41 and 54 preferably are about equal in surface area, but could be different. Spool cavity 53 is fluidly connected to variable pressure passage 35.

When variable pressure passage 35 is fluidly connected to high pressure manifold 14, such as when pilot valve member 31 is in its second position, pressure within spool cavity 53 is high and spool valve member 40 is preferably hydraulically balanced and maintained in its retracted position by biasing spring 49. When spool valve member 40 is in this position, device control passage 52 is blocked from fluid communication with high pressure passage 44 but fluidly connected to low pressure passage 47 via low pressure annulus 45. Conversely, when variable pressure passage 35 is fluidly connected to low pressure reservoir 12, such as when pilot valve member 31 is in its first position, pressure within spool cavity 53 is sufficiently low that the high pressure acting on high pressure surface 41 can to overcome the force of biasing spring 49, and spool valve member 40 can move to its advanced position. When spool valve member 45 is in this advanced position, device control passage 52 is blocked from low pressure passage 47 but high pressure fluid can flow into device control passage 52 via high pressure annulus 42 and high pressure passage 44.

Device control passage 52 is fluidly connected to a first device fluid supply passage 55 and a second device fluid supply passage 56. First device fluid supply passage 55 acts to fluidly connect device control passage 52 to a actuation fluid passage 70 (FIG. 3) defined by an injector body provided by fuel injector 60. Second device fluid supply passage 56 fluidly connects device control passage 52 to a brake fluid passage 93 (FIG. 4) defined by a brake body 91 provided by engine brake 90. As indicated, a modified brake/injector actuator control valve 24 could be substituted for brake/injector actuator control valve 24 and valve 23 illustrated herein. It should be appreciated that in this instance, first device supply passage 55 and second device fluid supply passage 56 would not be in fluid communication with a single device control passage 52. Rather, in this instance, device control passage 52 would be a first device control passage fluidly connected to first device fluid supply passage 56 and valve body 25 would define a second device control passage that would be in fluid communication with second device fluid supply passage 56. By independently controlling the connection of the first device control passage and the second device control passage to high pressure manifold 14 and low pressure reservoir 12, this modified actuator control valve could replace both brake/injector actuator control valve 24 and valve 23 without departing from the scope of the present invention.

Figure 3:
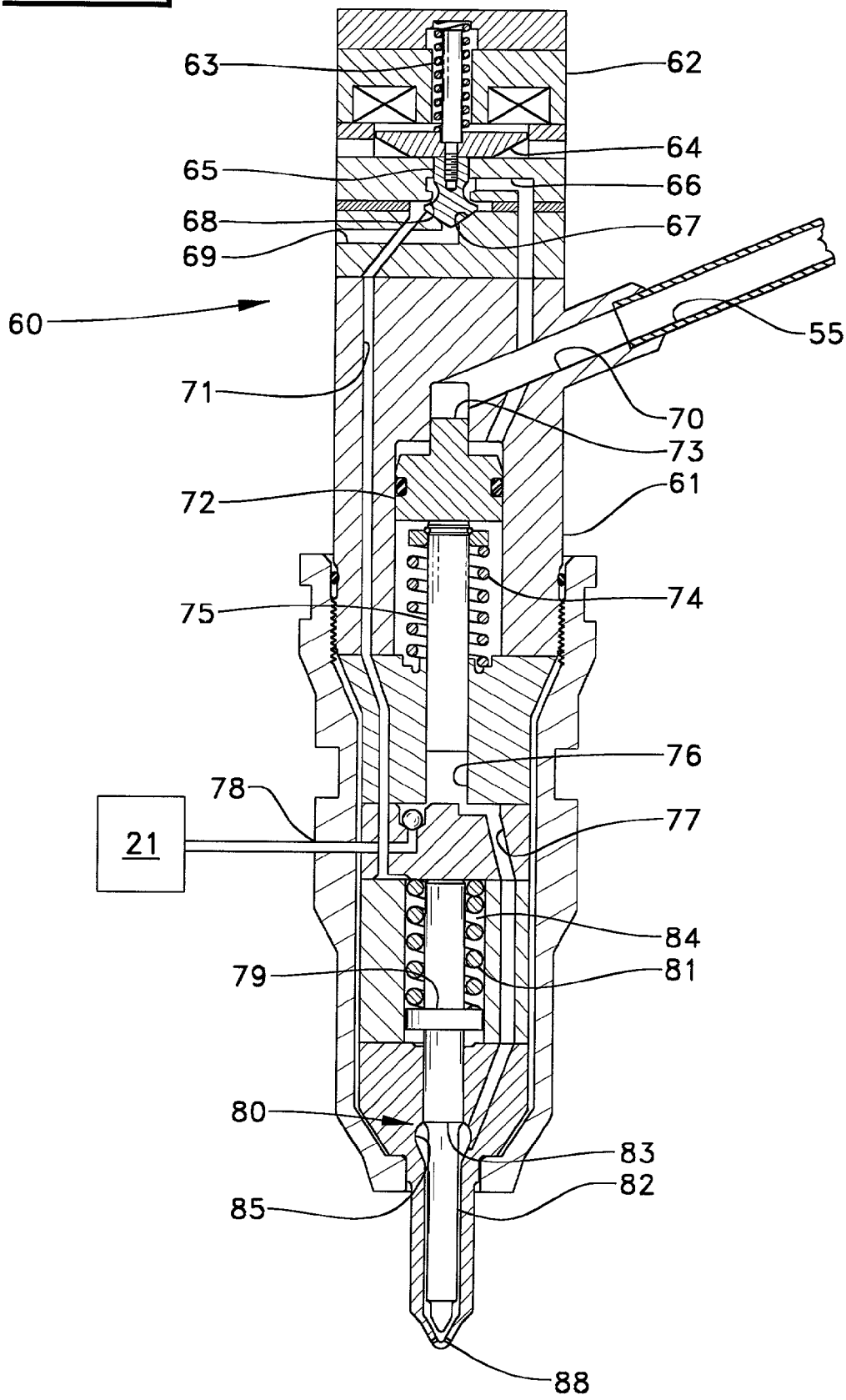
FIG. 3 is a sectioned side diagrammatic representation of a fuel injector according to the present invention.

Referring in addition to FIG. 3, there is shown a fuel injector 60 according to the present invention. Injector body 61 provides an electrical actuator 62, which is preferably a solenoid, that has an armature 64 attached to a needle control valve member 65, which is positioned in injector body 61 and movable between an upward position and a downward position. Those skilled in the art will recognize that electrical actuator 62 could instead be a piezoelectric actuator. Valve member 65 is preferably hydraulically balanced and biased toward its downward position by a biasing spring 63. Valve member 65 is preferably substantially identical in form and function to the pilot valve of actuator control valve 24. Actuation fluid passage 70 and pressure passage 66 are fluidly connected to either high pressure manifold 14 or low pressure reservoir 12 via device control passage 52 and first device fluid supply passage 56. When electrical actuator 62 is de-energized, such as between injection events, valve member 65 is moved to its downward position by the force of biasing spring 63 closing low pressure seat 67. When valve member 65 is in this position, a pressure communication passage 71 defined by injector body 61 is in fluid communication with pressure passage 66. When electrical actuator 62 is energized, such as just prior to an injection event, valve member 65 is preferably pulled to its upward position by armature 64 to open low pressure seat 67 and close high pressure seat 68. When valve member 65 is in this position, pressure communication passage 71 is blocked from fluid communication with pressure passage 66 and open to a low pressure passage 69 that is defined by injector body 61.

While fuel injector 60 has been illustrated creating a flow path between actuation fluid passage 70 and pressure communication passage 71, it should be appreciated that injector body 61 could be modified to eliminate this flow path. For instance, injector body 61 could instead define a fluid passage that is in fluid communication with high pressure manifold 14 directly, or with fuel pressurization chamber 76. When electrical actuator 62 is de-energized, valve member 65 is moved to its downward position under the force of biasing spring 63. In this instance, closing hydraulic surface 79 would be exposed to high pressure fluid in needle control chamber 84 whenever electrical actuator 62 is de-energized, and high pressure exists in passage 70.

Returning to fuel injector 60, an intensifier piston 72 is positioned in injector body 61 and includes a hydraulic surface 73 that is exposed to fluid pressure in actuation fluid passage 70. Piston 72 is biased toward a retracted, upward position by a biasing spring 74. However, when pressure within actuation fluid passage 70 is sufficiently high, such as when it is open to high pressure passage 44 via device control passage 52, piston 72 can move to an advanced, downward position against the action of biasing spring 74. A plunger 75 is also movably positioned in injector body 61 and moves in a corresponding manner with piston 72. When piston 72 is moved toward its advanced position, plunger 75 also advances and acts to pressurize fuel within a fuel pressurization chamber 76 that is connected to a fuel inlet 78 past a check valve. Fuel inlet 78 is in fluid communication with fuel source 21 via a fuel supply line. During an injection event as plunger 75 moves toward its downward position, the check valve is closed and plunger 75 can act to compress fuel within fuel pressurization chamber 76. When plunger 75 is returning to its upward position, fuel is drawn into fuel pressurization chamber 76 past the check valve. Fuel pressurization chamber 76 is fluidly connected to a nozzle outlet 88 via a nozzle supply passage 77.

Returning to fuel injector 60, a direct control needle valve 80 is positioned in injector body 61 and has a needle valve member 82 that is movable between a first position, in which nozzle outlet 88 is open, and a downward second position in which nozzle outlet 88 is blocked. Needle valve member 82 is mechanically biased toward its downward closed position by a biasing spring 81. Needle valve member 82 has an opening hydraulic surface 83 that is exposed to fluid pressure within a nozzle chamber 85 and a closing hydraulic surface 79 that is exposed to fluid pressure within a needle control chamber 84. Pressure communication passage 71 is in fluid communication with needle control chamber 84 and controls fluid pressure within the same.

Closing hydraulic surface 79 and opening hydraulic surface 83 are preferably sized such that even when a valve opening pressure is attained in nozzle chamber 85, needle valve member 82 will not lift open when needle control chamber 84 is fluidly connected to high pressure manifold 14 via brake/injector actuator control valve 24 and pressure communication passage 71. However, it should be appreciated that the relative sizes of closing hydraulic surface 79 and opening hydraulic surface 83 and the strength of biasing spring 81 should be such that when closing hydraulic surface 79 is exposed to low pressure in needle control chamber 84, a valve opening pressure acting on opening hydraulic surface 83 should be sufficient to move needle valve member 82 upward against the force of biasing spring 81 to open nozzle outlet 88. It should be further appreciated that the strength of biasing spring 81 should be such that needle valve member 82 will remain in its closed position even when pressure communication passage 71, and therefore needle control chamber 84 are open to low pressure reservoir 12 via device control passage 52.

Figure 4:
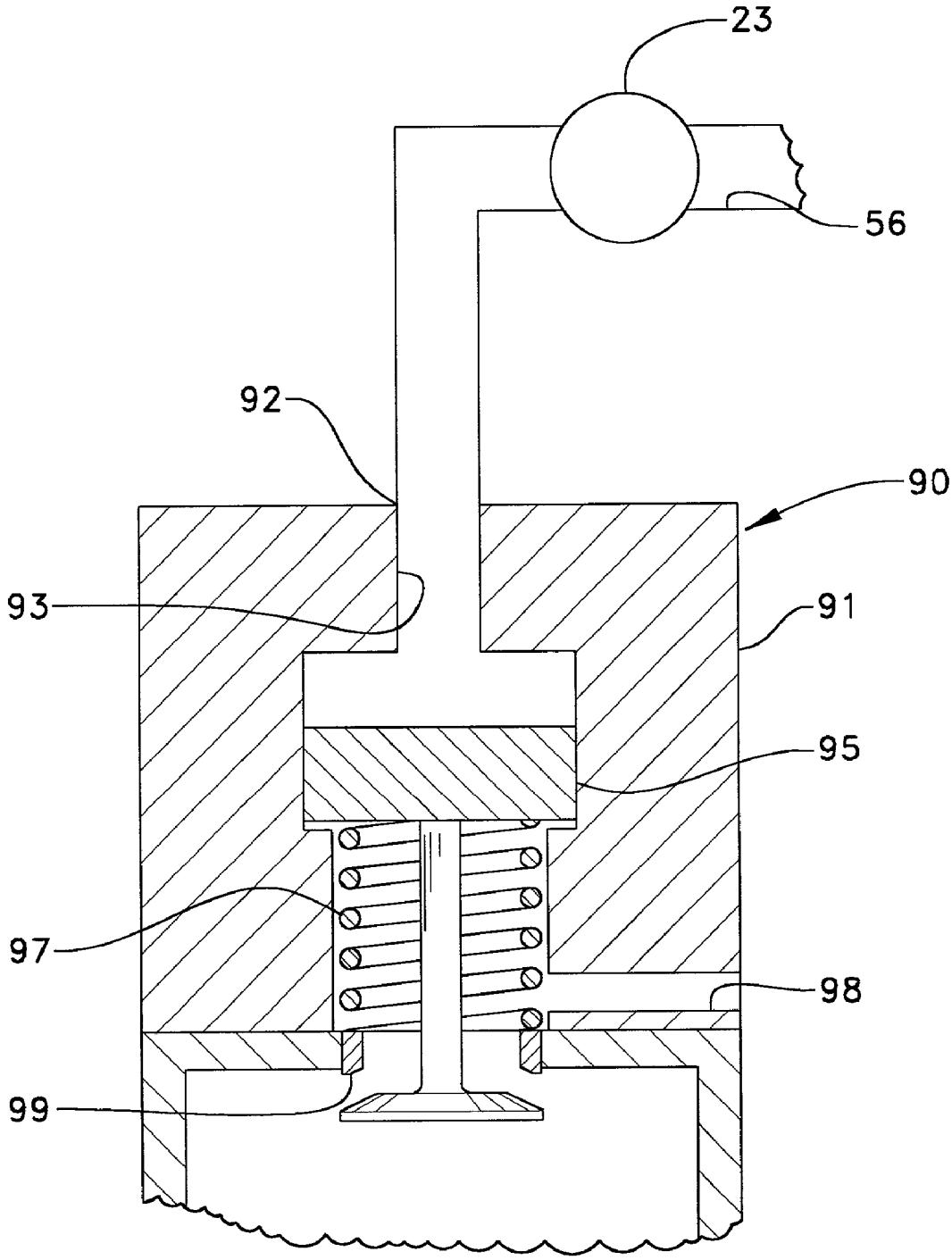
FIG. 4 is a sectioned side diagrammatic representation of an engine compression release brake according to the present invention.

Referring now to FIG. 4, there is shown an engine brake 90 according to the present invention. Engine brake 90 is preferably any engine brake that is positioned in engine 10 to vent compressed air within cylinder 19 toward the end of the compression stroke of piston 20. It is known in the art that injection and combustion are not always necessary, or desirable, during each cycle of piston 20. One such time might be when a vehicle having engine 10 is descending a relatively steep hill. During the descent, injection and combustion are not necessary and instead braking is often desirable. To increase efficiency of engine 10, and to decrease undesirable emissions created during unnecessary combustion, an engine brake, such as engine brake 90, is preferably operably coupled to each cylinder 19 of engine 10. When combustion is not desired, fuel is not injected into cylinder 19 at the end of the compression stroke, but instead, the compression of air in cylinder 19 during the compression stroke provides braking power for engine 10. This energy is released by engine brake 90 instead of being recovered as piston 20 retracts toward its downward position.

Returning to engine 10 and engine brake 90, as illustrated, brake/injector actuator control valve 24 functions as a flow control valve for engine brake 90. Engine brake 90 has a brake body 91 that defines a brake fluid passage 93 and a brake control inlet 92. Brake control inlet 92 and brake fluid passage 93 are fluidly connected to high pressure manifold 14 via device control passage 52 and second device fluid supply passage 56 when two way valve 23 is in its open position. A hydraulic actuator, piston 95, is positioned in brake body 91 and is movable between a retracted, upward position and an advanced, downward position. It should be appreciated that in addition to the hydraulic actuator provided in engine brake 90, the engine valve for cylinder 19 could also have a conventional actuator that is coupled to the cam shaft.

Piston 95 is biased toward its retracted position by a biasing spring 97. When two way valve 23 is in its closed position, brake fluid passage 93 remains at low pressure and piston 95 remains in its retracted position. When in this position, engine brake 90 is deactivated to prevent venting of engine from engine cylinder 19. However, when two way valve 23 is in its open position and actuator control valve 24 is activated, brake fluid passage 93 is fluidly connected to high pressure manifold 14. When this occurs, piston 95 is moved to its advanced position away from a seat component 99 against the action of biasing spring 97, and engine brake 90 can open cylinder 19 to an exhaust passage 98.

INDUSTRIAL APPLICABILITY

Referring to FIGS. 1–4, operation of the present invention will be discussed for one engine cylinder 19. It should be appreciated that while different cylinders are operating at different stages of their intake-compression-power-exhaust cycles at one time, the present invention operates in the same manner for each cylinder. Recall, in addition, that the present invention is being described for use with a four cylinder, four cycle engine 10. However, it should be appreciated that brake/injector actuator control valve 24 would find application in engines having a different number of cylinders or for those with cylinders operating under a different number of cycles.

Prior to the intake stage for cylinder 19, brake/injector actuator control valve 24 is in its first position such that pilot valve member 31 is in its second position, as shown, and spool valve member 40 is in its retracted position such that device control passage 52 is fluidly connected to low pressure reservoir 12. Two way valve 23 is in its closed position such that engine brake 90 is in an off or disabled condition, and cylinder 19 is closed to exhaust passage 98. Needle control valve member 65 of fuel injector 60 is in its downward, biased position, such that pressure communication passage 71 is fluidly connected to low pressure reservoir 12. Both closing hydraulic surface 79 and opening hydraulic surface 85 are exposed to low pressure, and needle valve member 82 is thus held in its downward position to close nozzle outlet 88 under the action of biasing spring 81. In addition, with low pressure acting on hydraulic surface 73, piston 72 and plunger 75 are in their upward, biased positions.

As engine piston 20 moves downward toward its bottom position, it draws air into cylinder 19 via the intake valve. Upon reaching its bottom dead center position, the intake stroke is ended and piston 20 begins to advance toward its upward position to compress the air that has been drawn into cylinder 19. Preferably, it is during this advancing movement of piston 20 that electronic control module 17 determines if fuel injection will be desirable at the end of the compression stroke. If it is, electrical actuator 26 is energized to move pilot valve member 31 to its upward, first position. However, it should be appreciated that this determination could be made at any suitable time prior to the end of the compression stroke of piston 20.

In order to initialize either an injection event or a actuation event, actuator control valve 24 is activated and moved to its second position. This begins by energizing solenoid coil 28 to move pilot valve member 31 upward to close high pressure seat 32. When pilot valve member 31 moves upward to its first position to close high pressure seat 32, variable pressure passage 35 is fluidly connected to low pressure reservoir 12. Hydraulic surface 54 of spool valve member 40 is now exposed to low pressure in spool cavity 53, and spool valve member 40 is moved to its advanced position by the high pressure acting on high pressure surface 41. Device control passage 52 is now open to high pressure passage 44 via high pressure annulus 42. High pressure fluid can now flow into first device fluid supply passage 55 and second device fluid supply passage 56. However, brake fluid passage 93 of engine brake 90 is not fluidly connected to high pressure manifold 14 because two way valve 23 remains in its closed position.

With high pressure actuation fluid flowing into actuation fluid passage 70, piston 72 and plunger 75 begin to move toward their advanced positions to pressurize fuel in fuel pressurization chamber 76 and nozzle chamber 85. However, because closing hydraulic surface 79 is now exposed to high pressure in needle control chamber 84 via pressure communication passage 71, needle valve member 82 will not be moved to its upward position to open nozzle outlet 88. Further, it should be appreciated that piston 72 and plunger 75 move only a slight distance at this time because of hydraulic locking, which is a result of nozzle outlet 88 remaining closed. However, the slight movement of piston 72 and plunger 75 is still sufficient to raise fuel pressure within fuel pressurization chamber 76 to injection pressure levels.

Just prior to the desired start of injection, when piston 19 is near its top dead center position to end the compression stroke, electrical actuator 62 is energized and pin 68 pulls valve member 65 toward its upward position blocking pressure communication passage 71 from the high pressure in pressure passage 66 and opening it to low pressure passage 69. Needle control chamber 84 is now open to low pressure. Because high pressure is no longer acting on closing hydraulic surface 79, the fuel pressure in nozzle chamber 85 is sufficient to overcome the bias of biasing spring 81 and needle valve member 82 moves to its open position to allow fuel injection into cylinder 19. As previously discussed, this fuel injection from injector 60 is timed to coincide with the end of the compression stroke of piston 20. When fuel is injected into cylinder 19, it ignites instantly due to the high temperature of the compressed air within cylinder 19. This combustion drives piston 20 downward for its power stroke.

Returning to fuel injector 60, when the desired amount of fuel has been injected into cylinder 19, electrical actuator 62 is de-energized and valve member 65 is returned to its downward position under the force of biasing spring 63 to open high pressure seat 68. Pressure communication passage 71 is now open to high pressure, thus exposing closing hydraulic surface 79 to high pressure fluid in needle control chamber 84. The high pressure acting on closing hydraulic surface 79 is sufficient to move needle valve 82 downward to close nozzle outlet 88 and end injection. However, because of hydraulic locking, piston 72 and plunger 75 stop their advancing movement, but do not immediately begin to retract because hydraulic surface 73 is still exposed to high pressure fluid in actuation fluid passage 70. It should be appreciated that if a split injection is desired, electrical actuator 62 would be re-energized and valve member 65 would be returned to its upward position fluidly connecting pressure communication passage 71 to low pressure passage 69. With closing hydraulic surface 79 once again exposed to low pressure, and with high pressure still acting on opening hydraulic surface 85, needle valve member 82 would once again be moved to its open position.

Once the injection event is completed, electrical actuator 26 is de-energized to allow brake/injector actuator control valve 24 to return to its first position, thus allowing pilot valve member 31 to return to its downward position, closing low pressure seat 33. Variable pressure passage 35 is now open to high pressure passage 44. Hydraulic surface 54 is exposed to high pressure within spool cavity 53, and spool valve member 40 once again becomes hydraulically balanced and begins to move toward its upward position under the action of biasing spring 49. Device control passage 52 is now blocked from high pressure passage 44 and open to low pressure passage 47, thus opening first device fluid supply passage 55 and second device fluid supply passage 56 to low pressure fluid. However, because two way valve 23 remains in its closed position, engine compression release brake valve 90 continues to be inactive.

Once first device fluid supply passage 55 is opened to low pressure passage 47, pressure within actuation fluid passage 70 is reduced and piston 72 and plunger 75 can return to their upward positions. As plunger 75 retracts, fuel from fuel source 21 can be drawn into fuel pressurization chamber 76 via fuel inlet 78 past the check valve. Recall that while closing hydraulic surface 79 is exposed to low pressure fluid via pressure communication passage 71, needle valve member 88 will remain in its closed position under the action of biasing spring 81 due to the low fluid pressure acting on opening hydraulic surface 85. As the components of fuel injector 60 are resetting themselves, piston 20 is advancing toward its top dead center position for its exhaust stroke to vent any residue from injection out of cylinder 19 via the engine compression release brake valve.

During a typical engine cycle, once piston 20 reaches the bottom dead center position for its power stroke, it begins to advance again for the exhaust stroke of the cylinder cycle. In other words, the engine exhaust valve is opened for the duration of the movement of piston 20 from its bottom dead center position to its top dead center position, and post combustion products remaining in cylinder 19 can be vented. In some instances, when piston 20 is advancing toward the top dead center position of its compression stroke, electronic control module 17 and/or the operator determine that fuel injection is not desirable, and instead engine brake 90 should be activated. At about top dead center, electrical actuator 26 of brake/injector actuator control valve 24 is again energized and moved to its second position, causing pilot valve member 31 to be moved to its upward position fluidly connecting variable pressure passage 35 to low pressure reservoir 12. Hydraulic surface 54 of spool valve member 40 is again exposed to low pressure in spool cavity 53, and spool valve member 40 is moved to its advanced position by the high pressure acting on high pressure surface 41. Device control passage 52, first device fluid supply passage 55 and second device fluid supply passage 56 are now open to high pressure passage 44 via high pressure annulus 42. However, because high pressure fluid is acting on closing hydraulic surface 79 via pressure communication passage 71 fuel injector 60 is disabled and fuel injection will not take place so long as electrical actuator 62 remains de-energized to maintain valve member 65 in its downward position. To begin the venting portion of an engine braking event, two way valve 23 is moved to its open position.

When two way valve 23 is in its open position, brake fluid passage 93 of engine brake 90 becomes fluidly connected to high pressure manifold 14 via second device fluid supply passage 56. With brake fluid passage 93 now open to high pressure manifold 14, piston 95 can advance against the bias of biasing spring 97, and engine brake 90 can vent the contents of cylinder 19. This preferably occurs as the piston 20 approaches its top dead center position during its compression stroke. In other words, in no contemplated case does the same cylinder undergo both an engine braking event and an injection event during the same cycle. It is this principal that allows a single actuator control valve, such as actuator control valve 24, to be utilized in controlling the activation of both engine brake 90 and fuel injector 60. Further, it is this principal that allows a modified actuator control valve, such as described to replace both actuator control valve 24 and valve 23, to be utilized in controlling the activation of both engine brake 90 and fuel injector 60. Once the compressed air has been vented from cylinder 19, current to electrical actuator 26 can be ended, allowing pilot valve member 31 to return to its downward position and spool valve member 40 to return to its retracted position, fluidly connecting device control passage 52, first device fluid supply passage 55 and second device fluid supply passage 56 to low pressure reservoir 12. With piston 95 again exposed to low pressure, it can return to its retracted position under the action of biasing spring 97 to close the exhaust port. Two way valve 23 is now returned to its closed position in anticipation of a subsequent engine braking or injection event.

It should be appreciated that the present invention provides a number of advantages over prior engine systems. For instance, because the fluid control line to the needle valve hydraulic surface has been separated from the fluid control line for the spool, greater control of the injection event can occur. In addition, because the number of fluid control valves has been reduced, the engine can be more robust. Further, because there are fewer working components within the engine, there are fewer components that can fail during engine operation.

It should be understood that the above description is intended for illustrative purposes only, and is not intended to limit the scope of the present invention in any way. For instance, while the present invention has been illustrated controlling only the fuel injector and the engine brake for each cylinder, it should be appreciated that it could also control a hydraulic intake valve for the cylinder. Additionally, while the present invention has been illustrated including a fuel injector having a flow path between the brake/injector actuator control valve and the closing hydraulic surface of the needle valve member, it should be appreciated that this flow path could be eliminated and replaced by a high pressure passage, as discussed above. Further, while the present invention has been illustrated including an actuator control valve and a two-way valve for each cylinder, it should be appreciated that a modified actuator control valve could be substituted to replace both of these components. For instance, a single actuator control valve, such as a rotary valve, could be utilized to control both the fuel injector and the engine brake by including separate hydraulic actuation lines that could be fluidly connected to each device, thereby eliminating the need for a valve to activate or deactivate one or both of the devices. Those skilled in the art will appreciate that if a non-direct-control fuel injector is used, some other means to disable the injector for an engine brake event would be needed. Such an alternative might utilize a three-way valve as a substitute for a two-way valve 23 described above. The three-way valve would have different positions that enable either the fuel injector or the engine brake, but not both simultaneously. Thus, those skilled in the art will appreciate that other aspects, objects and advantages of this invention can be obtained from a study of the drawings, the disclosure and the appended claims.

What is claimed is:

1. A hydraulic system comprising:

a source of high pressure fluid and a low pressure reservoir;

an actuator control valve including a valve body defining a high pressure passage fluidly connected to said source of high pressure fluid, a low pressure passage fluidly connected to said low pressure reservoir and a device control passage;

said actuator control valve being movable between a first position in which said device control passage is open to said low pressure passage, and a second position in which said device control passage is open to said high pressure passage;

said device control passage being fluidly connected to a first hydraulic device and a second hydraulic device;

said first hydraulic device is a fuel injector;

said second hydraulic device is an engine compression release brake;

said first hydraulic device includes a direct control needle valve having a closing hydraulic surface exposed to fluid pressure in a pressure communication passage; and an electrically controlled needle control valve operable to raise and lower pressure in said pressure communication passage.

2. An engine comprising:

an engine housing defining a plurality of cylinders;

an actuator control valve for each of said cylinders attached to said engine housing, said actuator control valve including a valve body that defines a device control passage, a high pressure passage and a low pressure passage;

an electronic control module being in control communication with said actuator control valve;

a first hydraulic device and a second hydraulic device for each of said plurality of cylinders being attached to said engine housing, and being fluidly connected to said device control passage;

a source of high pressure fluid being fluidly connected to said high pressure passage;

a low pressure reservoir being fluidly connected to said low pressure passage;

said actuator control valve being movable between a first position in which said device control passage is open to said low pressure passage and a second position in which said device control passage is open to said high pressure passage; and said first hydraulic device is a fuel injector including an injector body.

3. The engine of claim 2 wherein a two way valve is positioned between said actuator control valve and said second hydraulic device; and said two way valve is movable between an open position and a closed position.

4. The engine of claim 3 wherein said second hydraulic device is an engine compression release brake.

5. The engine of claim 4 wherein said engine compression release brake includes a brake body that defines a brake fluid passage; and said brake fluid passage is fluidly connected to said high pressure source by said device control passage when said actuator control valve is in said second position.

6. The engine of claim 5 wherein a direct control needle valve is positioned in said injector body that is movable between a closed position and an open position;

said direct control needle valve includes a closing hydraulic surface exposed to fluid pressure in a pressure communication passage; and an electrically controlled needle control valve operable to raise and lower pressure in said pressure communication passage.

7. The engine of claim 6 wherein said electrically controlled needle control valve including a needle control valve member positioned in said injector body and being movable between a first position opening said pressure communication passage to said actuation fluid passage and a second position blocking said pressure communication passage from said actuation fluid passage.

8. The engine of claim 6 wherein said direct control needle valve includes an opening hydraulic surface exposed to fluid pressure in a nozzle chamber defined at least in part by said injector body.

9. A method of operating a fuel injector and an engine compression release brake, comprising the steps of:

connecting an engine compression release brake and a fuel injector to an actuator control valve;

actuating said engine compression release brake at least in part by activating said actuator control valve to move from a first position to a second position, and disabling said fuel injector; and actuating said fuel injector at least in part by activating said actuator control valve to move from said first position to said second position.

10. The method of claim 9 wherein said step of disabling said fuel injector includes a step of holding a needle valve in a position that closes a nozzle outlet of said fuel injector.

11. The method of claim 9 wherein said step of actuating said fuel injector includes a step of relieving pressure on a closing hydraulic surface of said needle valve.

12. The method of claim 9 wherein said step of activating said actuator control valve includes a step of moving a pilot valve member from a first position to a second position.

13. A method of operating a fuel injector and an engine compression release brake, comprising the steps of:

connecting an engine compression release brake and a fuel injector to an actuator control valve;

actuating said engine compression release brake at least in part by activating said actuator control valve and disabling said fuel injector; and actuating said fuel injector at least in part by activating said actuator control valve;

positioning a valve between said engine compression release brake and said actuator control valve;

said step of actuating said engine compression release brake includes a step of opening said valve; and said step of actuating said fuel injector includes a step of closing said valve.

* * * * *